US008488804B2

(12) United States Patent
Bellows

(10) Patent No.: US 8,488,804 B2
(45) Date of Patent: Jul. 16, 2013

(54) SYSTEM AND METHOD FOR A HEADSET COMBINING A MICROPHONE AND AN ANTENNA

(75) Inventor: David Bellows, Wantagh, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 1150 days.

(21) Appl. No.: 11/855,237

(22) Filed: Sep. 14, 2007

(65) Prior Publication Data

US 2009/0074223 A1 Mar. 19, 2009

(51) Int. Cl.
*H04R 1/10* (2006.01)

(52) U.S. Cl.
USPC ..... 381/74; 381/370; 381/375; 381/378; 455/562.1; 455/575.7; 343/702; 343/718

(58) Field of Classification Search
USPC ..... 381/74, 375, 370, 378; 455/562.1, 455/575.7; 343/702, 718
See application file for complete search history.

(56) References Cited

U.S. PATENT DOCUMENTS

| | | | | |
|---|---|---|---|---|
| 6,396,935 | B1 * | 5/2002 | Makkonen | 381/334 |
| 6,760,454 | B1 * | 7/2004 | Shreve et al. | 381/110 |
| 2007/0120678 | A1 * | 5/2007 | Posamentier | 340/572.7 |
| 2007/0123323 | A1 * | 5/2007 | Zhu et al. | 455/575.2 |

FOREIGN PATENT DOCUMENTS

| | | | |
|---|---|---|---|
| KR | 100 369 124 | B1 | 1/2003 |
| WO | 95/15044 | A | 6/1995 |
| WO | 97/27721 | A | 7/1997 |
| WO | 2009035963 | | 3/2009 |

OTHER PUBLICATIONS

International Search Report and the Written Opinion of the International Searching Authority for International Application PCT/US2008/075689 mailed May 18, 2009.
International Preliminary Report on Patentability for counterpart International Application No. PCT/US2008/075689 mailed on Mar. 25, 2010.

* cited by examiner

*Primary Examiner* — Vivian Chin
*Assistant Examiner* — Paul Kim

(57) ABSTRACT

A headset comprises an audio output device, an audio input device, and a wire. The audio output device plays outgoing audio data. The audio input device receives incoming audio data. The wire connects the audio input device to a sound device that interprets the incoming audio data. The wire is further configured to be an antenna to one of transmit and receive radio frequency signals. The wire is further connected to a transceiver.

15 Claims, 4 Drawing Sheets

SYSTEM AND METHOD FOR A HEADSET COMBINING A MICROPHONE AND AN ANTENNA

FIELD OF THE INVENTION

The present invention relates generally to a headset that combines a microphone and an antenna. Specifically, the headset uses a connection for the microphone to serve as an antenna for a radio frequency identification functionality.

BACKGROUND

A headset allows a user to place an audio output device and an audio input device on the user's head to free the user's hands. When the headset is properly placed on the user's head, the audio output device such as a speaker is located on or around an ear of the user while the audio input device such as a microphone is located in the vicinity of a mouth of the user. The headset may be equipped with a boom that places the audio input device in the vicinity of the mouth of the user. The boom may include wiring to establish an electrical connection from the microphone to a sound device.

SUMMARY OF THE INVENTION

The present invention relates to a headset. The headset comprises an audio output device, an audio input device, and a wire. The audio output device plays outgoing audio data. The audio input device receives incoming audio data. The wire connects the audio input device to a sound device that interprets the incoming audio data. The wire is further configured to be an antenna to one of transmit and receive radio frequency signals. The wire is further connected to a transceiver.

DETAILED DESCRIPTION

Figure 1:
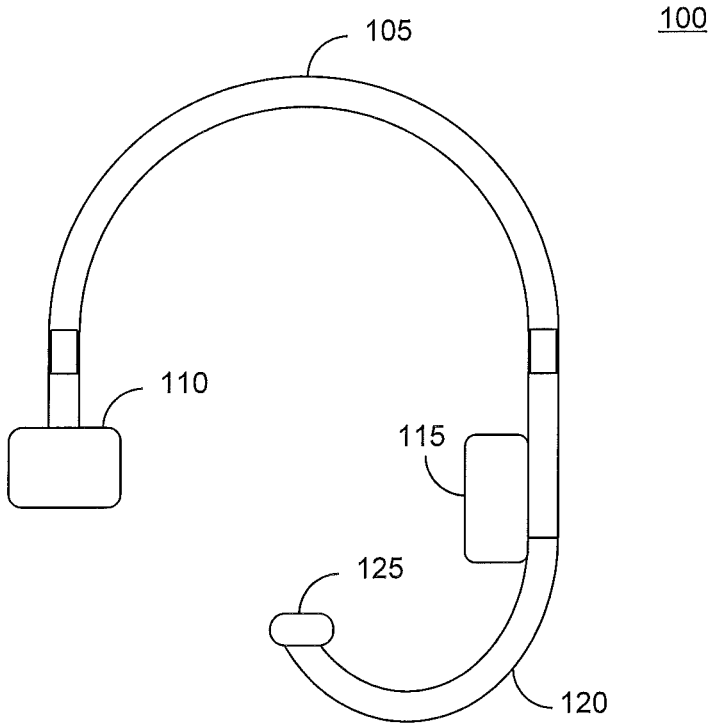
FIG. 1 shows a first perspective view of a headset according to an exemplary embodiment of the present invention.

The exemplary embodiments of the present invention may be further understood with reference to the following description and the appended drawings, wherein like elements are referred to with the same reference numerals. The exemplary embodiments of the present invention describe a headset that combines a microphone and a radio frequency identification (RFID) antenna. Specifically, the exemplary embodiments of the present invention may utilize a wiring connecting the microphone to a sound device as the RFID antenna for an RFID functionality. Thus, according to the exemplary embodiments of the present invention, the audio system and the RFID system of the headset are combined as a single system providing functionalities of both systems. The headset, the microphone, and the wiring/RFID antenna will be discussed in more detail below. Those skilled in the art will understand that while the exemplary embodiments describe an RFID antenna, the exemplary embodiments may be modified to include an antenna that operates in other frequency spectra.

FIG. 1 shows a first perspective view of a headset 100 according to an exemplary embodiment of the present invention. The headset 100 may be any device that includes an audio output component and/or an audio input component. The headset 100 may be a stand alone unit or may be used in conjunction with other electronic devices. For example, the headset 100 may be electrically connected to a mobile unit (MU) so that data may be exchanged between the headset 100 and the MU. The electrical connection may be, for example, a wired connector from the headset 100 with a jack that plugs into a port of the MU. The headset 100 may include a head band 105, a cushion 110, an audio output 115, a boom 120, and an audio input 125.

The head band 105 may be a supporting mechanism to allow the headset 100 to be used hands-free. The head band 105 may rest on a top surface of a user's head. The head band 105 may be partially elastic so that the head band 105 may flex to conform to the top surface of the user's head. The head band 105 may be manufactured, for example, of a semi-elastic polymer with a spring metal interior. The cushion 110 may be a padding disposed at a first end of the head band 105. The padding may provide a comfortable end to the head band 105. Because the ends of the head band 105 partially squeeze (e.g., to securely hold the head set 100 on the user's head), the cushion 110 may allow the comfortable use of the headset 100. It should be noted that the headset 100 including the head band 105 and the cushion 110 is only exemplary. The headset 100 may include an ear clip so that the headset 100 may be worn on a user's ear. In such an embodiment, the head band 105 and the cushion 110 may be unnecessary.

The audio output 115 may be, for example, a speaker. The audio output 115 may be disposed at a second end of the head band 105. The audio output 115 may include a cushion substantially similar to the cushion 110. Again, because the ends of the head band 105 partially squeeze, the cushion of the audio output 115 may provide the comfortable wearing of the headset 100. When the headset 100 is placed in a proper orientation on the user's head, the audio output 115 may be disposed around a user's ear. Furthermore, the cushion 110 may be disposed slightly above a user's other ear. The audio output 115 may be electrically connected to a sound device. The sound device will be explained in further detail below with reference to FIG. 3.

The boom 120 may be a flexible extension that includes a wiring. A first end of the boom 120 may be attached to the second end of the head band 105. A second end of the boom 120 may be attached to the audio input 125. The wiring within the boom 120 may electrically connect the audio input 125 to the sound device. The audio input 125 may be, for example, a microphone. The flexibility of the boom 120 may allow a user to orient the headset 100 so that the audio input 125 is disposed in the vicinity of a user's mouth. The audio input 125 may include a foam coat so that sounds received by the audio input 125 may be filtered.

Figure 2:
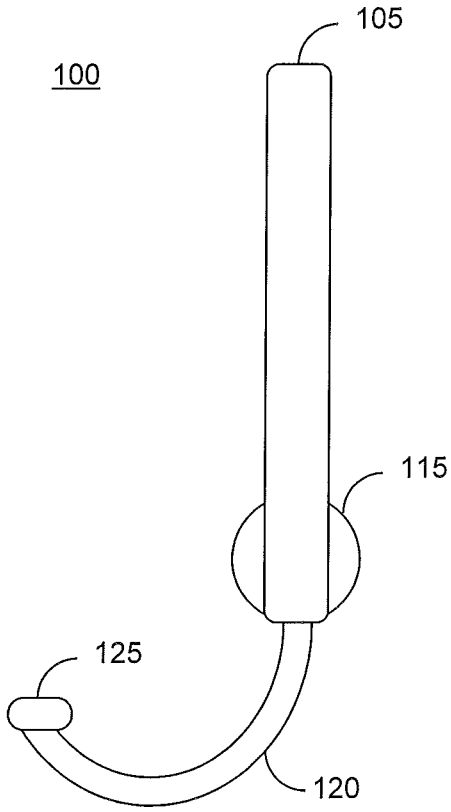
FIG. 2 shows a second perspective view of the headset of FIG. 1 according to an exemplary embodiment of the present invention.

FIG. 2 shows a second perspective view of the headset 100 of FIG. 1 according to an exemplary embodiment of the present invention. Specifically, the second perspective view of the headset 100 shows a head-on view of a right side of the headset 100 of FIG. 1. The second perspective view shows the head band 105, the audio output 115, the boom 120, and the audio input 125. As discussed above, the audio output 115 and the first end of the boom 120 may be disposed at the second end of the head band 105. The audio input 125 may be disposed at the second end of the boom 120. The audio output 115 may be substantially circular in cross section to, for example, cover most of the user's ear. The boom 120 illustrates the flexibility so that the audio input 125 may be oriented in an appropriate location to receive audio input from the user.

Figure 3:
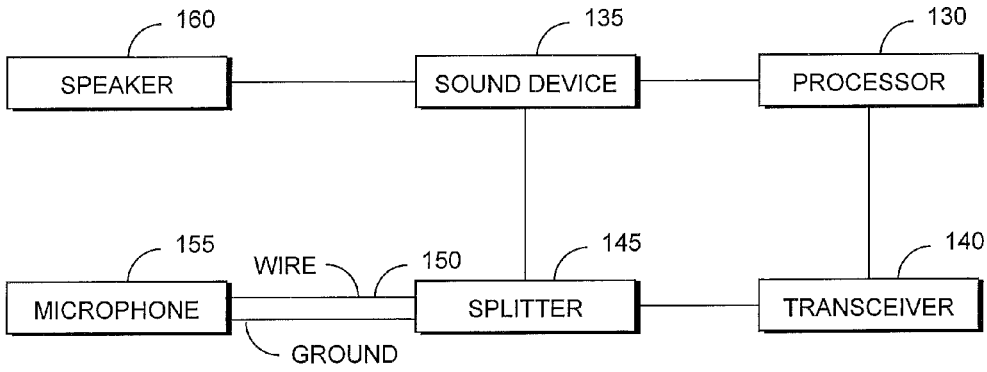
FIG. 3 shows electronic components of the headset of FIGS. 1-2 according to an exemplary embodiment of the present invention.

FIG. 3 shows electronic components of the headset 100 of FIGS. 1-2 according to an exemplary embodiment of the present invention. The electronic components of FIG. 3 will be described with reference to the components of the headset 100. It should be noted that the electronic components of the headset 100 may also apply to the headset with no head band 105 and/or the cushion 110. With reference to the electronic components, the headset 100 may include a processor 130, a sound device 135, a transceiver 140, a splitter 145, wires 150, a microphone 155, and a speaker 160.

The processor 130 may be a central computing unit. As discussed above, the headset 100 may be a stand alone unit or may be electrically connected to an electronic device. Thus, the processor 130 may be a unit of the headset 100 (e.g., when the headset 100 is a stand alone unit) or may be a unit of the electronic device (e.g., when the headset 100 is an accessory).

The sound device 135 may be, for example, a sound card for a computing device. The sound device 135 may relay audio data to the speaker 160 so that the audio output 115 may play the audio data. The sound device 135 may also receive audio data. The reception of audio data will be discussed with reference to the microphone 155. The transceiver 140 may transmit and/or receive, for example, radio frequency data such as radio frequency identification (RFID) data. Those skilled in the art will understand that the transceiver 140 works in conjunction with an antenna. The antenna will be discussed with reference to the wires 150. The microphone 155 may include circuitry to enable reception of audio data from the audio input 125. Thus, the received audio data may be forwarded to the sound device 135. The microphone 155 may be connected to the electronic components discussed above via the wires 150.

The wires 150 serve to connect the microphone 155 to the sound device 135. The wires 150 may be located within the boom 120. According to the exemplary embodiments of the present invention, the wires 150 may also serve as the antenna for the transceiver 140. The wires 150 may be manufactured of a conducting metal. It should be noted that the use of wires is only exemplary. The wires 150 may also be embodied using a flex circuit, a ribbon cable, copper tape, etc. Those skilled in the art will understand that when an antenna is mounted on or near other electrically conductive material, resonance frequency is in part a function of the metallic, electrically conductive surface in which the antenna is mounted. Thus, because the wires 150 are connected to the microphone 155, the microphone 155 may serve as an end-loading capacitor for the wires 150 when serving as the antenna for the transceiver 140.

The boom 120 may be, for example, about six inches long. The six inches may allow the audio input 125 to be oriented in an appropriate position relative to the user's mouth. Inherent to the six inch length of the boom 120 is a six inch length of the wires 150. Thus, the antenna for the transceiver 140 is six inches. Those skilled in the art will understand that the six inch length of the antenna is an optimum length for the antenna, in particular for RFID functionalities.

In other exemplary embodiments, the boom 120 may be shorter or longer. For example, the boom 120 may be about three inches long or nine inches long. Inherent to these lengths of the boom 120 is a three inch length or nine inch length of the wires 150. Thus, the antenna for the transceiver 140 may be three inches or nine inches, respectively. Those skilled in the art will understand that a three inch length or a nine inch length of the antenna are also optimum lengths for the antenna, in particular for RFID functionalities.

RFID functionalities generally operate between 902 MHz and 928 MHz. Thus, a single sine wave of the RFID wave is between $1.103\times10^{-9}$ seconds and $1.078\times10^{-9}$ seconds, respectively. Half a wavelength for the RFID wave at an ultra high frequency (UHF) band is thus between $5.543\times10^{-10}$ seconds and $5.388\times10^{-10}$ seconds, respectively. Because the waves are measured against the speed of light, an optimal length for these operating parameters is between 6.54 inches and 6.36 inches, respectively. It should be noted that the half a wavelength being a first optimal length is only exemplary. Other exemplary optimal lengths may include a quarter wavelength and a three-quarters wavelength. The quarter wavelength may correspond to 3.27 inches to 3.18 inches while the three-quarters wavelength may correspond to 9.81 inches to 9.54 inches. As discussed above, the boom 120 and thus the wires 150 may be shorter (e.g., three inches) or longer (e.g., nine inches). Thus, the shorter wires 150 (and thus the antenna length) may be used for the quarter wavelength while the longer wires 150 may be used for the three-quarters wavelength.

As explained above, the proper electrical length of the antenna for RFID functionalities operating between 902 MHz and 928 MHz is between 6.54 inches and 6.36 inches, respectively. Depending on the capacitive and inductive loading of the antenna, the physical length may be greater than or less than this range. For example, the presence of the microphone 155 itself is an end-loading capacitor and may change the necessary physical length of the wires 150 to create a functional RFID antenna.

In addition, the audio input 125 may receive audio data. The audio data may be transmitted by the microphone 155 across the wires 150 in an audio range of 20 Hz to 20 kHz. With the RFID antenna transmitting frequencies in the range of 902 MHz to 928 MHz and the audio data transmitting frequencies in the range of 20 Hz and 20 kHZ, those skilled in the art will understand that the bands are significantly apart enough to allow for both functions to operate simultaneously without any interference on each other.

The splitter 145 is an exemplary unit that receives any data from the wires 150. Because both RFID data and audio data is transmitted through the wires 150, the splitter 145 may appropriately forward data falling in predetermined ranges to go to an appropriate component. For example, audio data is received through the wires 150 between 20 Hz and 20 kHz. The splitter 145 may recognize this and forward the audio data to the sound device 135. In another example, RFID data is received through the wires 150 between 902 MHz and 928 MHz. The splitter 145 may recognize this and forward the RFID data to the transceiver 140. The splitter may include, for example, a filter or series of filters to separate and/or split the signals and forward the signals to the correct component.

It should be noted that the use of the splitter 145 is only exemplary. The exemplary embodiments of the present invention may include the wires 150 being connected to the processor 130, directly (e.g., to a pin of the processor 130) or indirectly (e.g., to a pin on a printed circuit board in which the processor 130 is disposed). That is, the processor 130 may be responsible for forwarding the data to the appropriate component. In yet another embodiment, the wires 150 may be connected to either the sound device 135 or the transceiver 140. Because the sound device 135 and the transceiver 140 are configured to interpret a type of data ranging in a particular frequency, any data not falling into the configured range may be forwarded to the other component. For example, if the data from the wire 150 includes audio data and RFID data, the data may first be sent to the sound device 135. Any data ranging from 20 Hz to 20 kHz may be interpreted by the sound device 135. All other data may be forwarded to the transceiver 140. In another example, if the data from the wire 150 includes audio data and RFID data, the data may first be sent to the transceiver 140. Any data ranging from 902 MHz to 928 MHz may be interpreted by the transceiver 140. All other data may be forwarded to the sound device 135.

In yet another exemplary embodiment, data from the wire 150 may be forwarded to the splitter 145. The splitter 145 may forward the data to the sound device 135 and the transceiver 140. That is, the same data is forwarded to both components. The data from the wire 150 may be, for example, a signal so that the splitter 145 may send the signal to both components. In this exemplary embodiment, a filter may be disposed between the splitter 145 and the sound device 135 and between the splitter 145 and the transceiver 140. The filter disposed before the sound device 135 may be configured to receive the signal from the splitter 145 and only transmit a portion of the signal that falls in the frequency range for audio data (e.g., frequency ranging from 20 Hz to 20 kHz). The filter disposed before the transceiver 140 may be configured to receive the signal from the splitter 145 and only transmit a portion of the signal that falls in the frequency range for RFID data (e.g., frequency ranging from 902 MHz to 928 MHz). It should be noted that in an embodiment where only a single type of data is included, the entire signal is transmitted to the respective component. For example, when only audio data is present, the filter disposed before the sound card 135 allows the entire signal to be transmitted while the filter disposed before the transceiver 140 blocks the entire signal.

In addition, as discussed above, the processor 130 may be part of the headset 100 (e.g., when the headset 100 is a stand alone unit) or may be part of an electronic device (e.g., when the headset 100 is an accessory). Substantially the same disposition of the sound device 135 and the transceiver 140 may be made. That is, the sound device 135 and the transceiver 140 may be disposed as part of the headset 100 (e.g., when the headset 100 is a stand alone unit) or may be part of an electronic device (e.g., when the headset 100 is an accessory). When the headset 100 is an accessory, the wires 150, the microphone 155, and the speaker 160 may be the only components of the headset 100.

It should be noted that the above description of the wires 150 pertains to when data is transmitted from the microphone 155 to the sound device 135 or, when the wires 150 is an antenna, from the antenna to the transceiver 140. However, those skilled in the art will understand that the transceiver 140 may forward signals to the antenna for propagation of the signals. Thus, data may also flow in an opposite directions on the wires 150.

Figure 4:
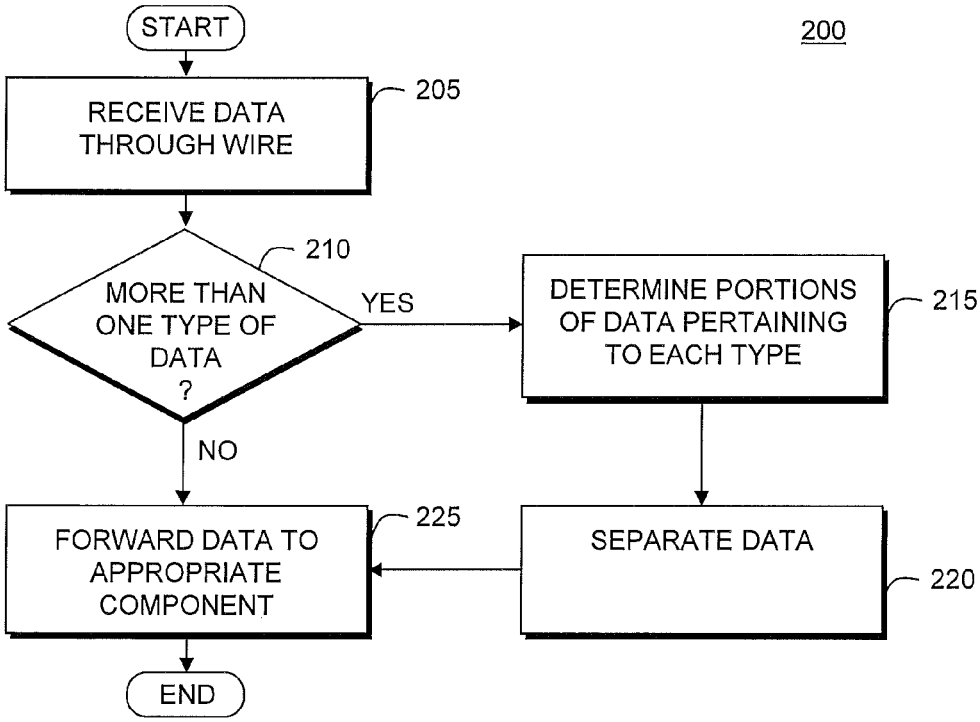
FIG. 4 shows a method of utilizing data transmitted over a common wire according to an exemplary embodiment of the present invention.

FIG. 4 shows a method 200 of utilizing data transmitted over a common wire according to an exemplary embodiment of the present invention. The method 200 will be described with reference to the headset 100 of FIGS. 1-2 and the electronic components of the headset 100 of FIG. 3. The method 200 may also apply to the embodiment described above in which the headset 100 does not include the head band 105 and the cushion 110.

In step 205, data is received through the wire 150. Specifically, audio data is received by the audio input 125 and the microphone 155 and transmitted through the wire 150. RFID data is also received by the wire 150 acting as the antenna for the transceiver 140. The audio data and/or the RFID data may be received, for example, by the splitter 155, the processor 130, the sound device 135, or the transceiver 140.

In step 210, a determination is made if more than one type of data exists from the received data via the wire 150. Since audio data and RFID data may be transmitted simultaneously through the wire 150, this determination aids in a subsequent forwarding of the data to the appropriate component. The determination may be made by any of the possible components that receive the data. For example, the splitter 145 or the processor 130 may determine frequencies of the data. In another example, the sound device 135 may determine the data by interpreting only audio data and forwarding the other data. In yet another example, the transceiver 140 may determine the data by interpreting only RFID data and forwarding the other data.

If step 210 determines that more than one type of data exists, the method 200 continues to step 215. In step 215, the portions of the received data pertaining to audio data and RFID data are determined. In step 220, the data is separated. That is, the audio data and the RFID data is separated so that the appropriate portions may be forwarded to the respective components (i.e., step 225).

As discussed above, data may be transmitted in an opposite direction on the wires 150. Thus, the method 200 may include additional steps to incorporate this opposite flow of data. For example, a step may include determining a direction in which data is traveling on the wire. If the direction of the data is toward a receiving component such as the splitter 145, the processor 130, the sound device 135, or the transceiver 140, the method 200 may follow the steps described above. If the direction of the data is away from the transceiver 140, then a step may be included to propagate the signals originating from the transceiver 140.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A headset, comprising:

an audio input device operable to receive incoming audio signals; and a single strand of wire electrically connecting the audio input device to a sound device;

the sound device operable to interpret the incoming audio signals, the same single strand of wire electrically-connected to the audio input device further being configured to be an antenna to one of transmit and receive radio frequency signals, the single strand of wire further being connected to a radio frequency transceiver;

wherein the radio frequency transceiver is a radio frequency identification transceiver, and wherein the radio frequency signals include radio frequency identification data; and wherein the incoming audio signals and the radio frequency identification data are transmitted through the single strand of wire concurrently.

2. The headset of claim 1, further comprising:

a splitter connected in the single strand of wire such that the splitter couples audio signals from the audio input device to the sound device and couples RF data between the radio frequency transceiver and the single strand of wire.

3. The headset of claim 2, further comprising:

an audio filter coupled between the splitter and the sound device, the audio filter configured to pass signals in an audio frequency range; and a radio frequency filter coupled between the splitter and the radio frequency transceiver, the radio frequency filter configured to pass signals in a radio frequency range.

4. The headset of claim 1, further comprising:

a boom housing the wire, the audio input device being disposed on a first end of the boom.

5. The headset of claim 4, wherein the boom is flexible to orient the audio input device substantially near a mouth of a user.

6. The headset of claim 1, wherein a length of the single strand of wire is substantially one of three inches, six inches, and nine inches.

7. The headset of claim 1, wherein the radio frequency signal is transmitted through the single strand of wire at an operating frequency between 902 MHz and 928 MHz.

8. The headset of claim 1, wherein the incoming audio signal is transmitted through the single strand of wire at an operating frequency between 20 Hz and 20 kHz.

9. The headset of claim 1, wherein the audio input device is a microphone that acts as an end-loading capacitor when the single strand of wire is used as the antenna.

10. A method, comprising:

receiving audio signals through a single strand of electrically-connected wire, the single strand of wire connecting an audio input device to a sound device that interprets incoming audio signals, the same single strand of wire electrically-connected to the audio input device further being configured to be an antenna to one of transmit and receive radio frequency data, the single strand of wire further being connected to a radio frequency transceivers;

further comprising splitting signals in the single strand of wire to couple audio signals from the audio input device to the sound device and to couple RF data between the radio frequency transceiver and the single strand of wire; and further comprising:

filtering audio signals to pass audio signals in an audio frequency range from the audio input device to the sound device; and filtering radio frequency data to pass radio frequency data in a radio frequency range between the radio frequency transceiver and the single strand of wire.

11. The method of claim 10, wherein the incoming audio data is transmitted through the single strand of wire at an operating frequency between 20 Hz and 20 kHz.

12. The method of claim 10, wherein the radio frequency identification data is transmitted through the single strand of wire at an operating frequency between 902 MHz and 928 MHz.

13. The method of claim 10, wherein the incoming audio signals and the radio frequency identification data are transmitted through the single strand of wire concurrently.

14. The method of claim 10, wherein the audio input device is a microphone that acts as an end-loading capacitor when the single strand of wire is used as the antenna.

15. The method of claim 10, further comprising:

determining if the radio frequency identification data originated from the transceiver; and propagating signals relating to the radio frequency identification data through the single strand of wire.

* * * * *